US012644348B2

(12) United States Patent
Yzerman et al.

(10) Patent No.: US 12,644,348 B2
(45) Date of Patent: Jun. 2, 2026

(54) SYSTEM AND METHOD FOR ROBOTIC DRILL ROD HANDLING

(71) Applicant: Reko Automation Group Inc., Lakeshore (CA)

(72) Inventors: Greg Yzerman, Essex (CA); Barrie Cutting, Amherstburg (CA); Christopher Serran, Windsor (CA); Benjamin Watson, Essex (CA); Paul Rauch, Kingsville (CA); Alexander Christie, Smithers (CA); Bill Krasnozon, Saskatoon (CA)

(73) Assignee: REKO Automation Group Inc., Lakeshore (CA)

( * ) Notice: Subject to any disclaimer, the term of this patent is extended or adjusted under 35 U.S.C. 154(b) by 0 days.

(21) Appl. No.: 18/830,040

(22) Filed: Sep. 10, 2024

(65) Prior Publication Data

US 2025/0084712 A1 Mar. 13, 2025

Related U.S. Application Data

(60) Provisional application No. 63/582,277, filed on Sep. 13, 2023.

(51) Int. Cl.
*E21B 19/20* (2006.01)

(52) U.S. Cl.
CPC ..... *E21B 19/20* (2013.01)

(58) Field of Classification Search
CPC ..... E21B 19/14; E21B 19/155; E21B 19/15; E21B 19/20; E21B 19/16; E21B 19/24; E21B 19/087; E21B 19/164; E21B 19/165
See application file for complete search history.

(56) References Cited

U.S. PATENT DOCUMENTS 5,941,324 A * 8/1999 Bennett ..... E21B 19/14 175/85
6,179,065 B1 * 1/2001 Payne ..... E21B 19/15 175/85

(Continued)

FOREIGN PATENT DOCUMENTS

CN 105239938 A 1/2016
CN 107143293 A 9/2017

(Continued)

OTHER PUBLICATIONS

European Patent Office, Extended European Search Report for EP 24199614.9, Jan. 8, 2025.

*Primary Examiner* — Kipp C Wallace
(74) *Attorney, Agent, or Firm* — Own Innovation; Osman Ismaili; James W. Hinton

(57) ABSTRACT

Disclosed herein is a system and associated method for robotic drill rod handling. The system includes a frame, a drill rod magazine for storing and dispensing drill rods, the magazine removably coupled to the frame, a robotic arm for manipulating drill rods, the robotic arm coupled to the frame and a drill rod end effector, for grasping drill rods, the end effector coupled to the robotic arm. The system is configured to manipulate the robotic arm such that the end effector surrounds a second drill rod in a grasping position of the system, grasp the second drill rod with the end effector, manipulate the second drill rod to align the second drill rod with a first drill rod which is coupled to a drilling rig and rotate the second drill rod to couple the second drill rod to the first drill rod.

20 Claims, 7 Drawing Sheets

(56) References Cited

U.S. PATENT DOCUMENTS

| | | | | |
|---|---|---|---|---|
| 11,236,558 | B2 * | 2/2022 | LaValley | E21B 19/163 |
| 12,044,081 | B2 * | 7/2024 | Larose | E21B 19/08 |
| 2009/0314137 | A1 * | 12/2009 | Perez | E21B 19/168<br>81/57.16 |
| 2012/0297933 | A1 * | 11/2012 | Lavalley | E21B 19/161<br>137/15.08 |
| 2013/0283589 | A1 * | 10/2013 | Lavalley | E21B 19/161<br>29/426.5 |
| 2014/0209382 | A1 * | 7/2014 | Smith | E21B 19/14<br>175/24 |
| 2015/0259993 | A1 * | 9/2015 | Patel | E21B 19/163<br>175/52 |
| 2016/0115751 | A1 * | 4/2016 | Jelgert | E21B 7/02<br>166/380 |
| 2019/0309586 | A1 | 10/2019 | Søyland et al. | |
| 2021/0025252 | A1 * | 1/2021 | Magnuson | E21B 19/164 |
| 2022/0136343 | A1 * | 5/2022 | Wythes | E21B 19/155<br>166/380 |

FOREIGN PATENT DOCUMENTS

| | | | |
|---|---|---|---|
| CN | 107186533 | A | 9/2017 |
| CN | 207620745 | U | 7/2018 |
| CN | 109281626 | A | 1/2019 |
| CN | 109488232 | A | 3/2019 |
| CN | 209742814 | U | 12/2019 |
| CN | 209830324 | U | 12/2019 |
| CN | 212027710 | U | 11/2020 |
| CN | 112074646 | A | 12/2020 |
| CN | 112796656 | A | 5/2021 |
| EP | 0258705 | A2 | 3/1988 |
| EP | 2803812 | A1 | 11/2014 |
| WO | 2014117036 | | 7/2014 |

* cited by examiner

SYSTEM AND METHOD FOR ROBOTIC DRILL ROD HANDLING

TECHNICAL FIELD

The following relates generally to a system and associated method for the robotic handling of drill rods, and specifically, a system, and associated method, comprising a robotic arm, drill rod end effector, and drill rod magazine coupled to the robotic arm.

INTRODUCTION

Drill rods may be used in mining operations to drill deep into surfaces. Drill rods may be provided in specific fixed lengths, with each drill rod comprising threading interfaces at each end. In order to drill to depths deeper than the fixed lengths of provided drill rods, drill rods may be coupled to one another through threaded interfaces.

Drill rods are constructed from heavy materials such as tool steel, and are thus difficult to handle efficiently by hand. Accordingly, robotic systems may be used to handle drill rods instead of manually manipulating drill rods. Currently known robotic drill rod handling systems may not be well suited for use in compact spaces, such as mines or caves, or may require complicated setup and calibration for each individual deployment, increasing time and labour costs associated with the use of the drill rod handling robotic system.

Accordingly, there is need for a system and method which may avoid these shortcomings.

SUMMARY

Described herein is a robotic system for drill rod handling. According to some embodiments, the drill rod handling robotic system includes a frame, a drill rod magazine for storing and dispensing drill rods, the magazine removably coupled to the frame, a robotic arm for manipulating drill rods, the robotic arm coupled to the frame and a drill rod end effector, for grasping drill rods, the end effector coupled to the robotic arm, wherein the system is configured to manipulate the robotic arm such that the end effector surrounds a second drill rod in a grasping position of the system, grasp the second drill rod with the end effector, manipulate the second drill rod to align the second drill rod with a first drill rod which is coupled to a drilling rig and rotate the second drill rod to couple the second drill rod to the first drill rod.

According to some embodiments, the end effector is configured to grasp and rotate drill rods about a first axis.

According to some embodiments, the end effector comprises a thread compensation mechanism for translating a grasped drill rod about a first axis.

According to some embodiments, the drill rod magazine is a gravity fed magazine, with the drill rods arranged in the magazine horizontally relative to the ground.

According to some embodiments, the system further comprises a carriage system coupled to the frame.

According to some embodiments, the carriage system further comprises a rod lifter and a carriage configured to convey a drill rod.

According to some embodiments, the system is further configured to grasp the second drill rod coupled to a first drill rod with the end effector, wherein the first drill rod is coupled to the drilling rig, rotate the grasped first drill rod to decouple the second drill rod from the first drill rod, manipulate the second drill rod using the robotic arm to place the second drill rod in the grasping position and decouple the end effector from the second drill rod.

According to some embodiments, the frame is leveled to a ground surface.

According to some embodiments, the robotic arm comprises six degrees of freedom.

According to some embodiments, the system is configured to operate autonomously.

Described herein is a method of robotic drill rod handling. According to some embodiments, the method includes grasping a second drill rod from a grasping position of a frame of a drill rod handling system with an end effector of a robotic arm, wherein the second drill rod is in a grasping position, manipulating the second drill rod with the robotic arm such that a threaded first end of the second drill rod is contacting a threaded second end of a first drill rod, applying a preload force to the second drill rod, rotating the second drill rod in the forward direction of the threads of the first end, coupling the first drill rod and second drill rod, and decoupling the end effector from the second drill rod.

According to some embodiments, the first drill rod is coupled to a drilling rig.

According to some embodiments, the drill rod handling system comprises a removable drill rod magazine.

According to some embodiments, the drill rod magazine is a gravity fed magazine, with the drill rods arranged in the magazine horizontally relative to the ground.

According to some embodiments, the frame comprises a leveling jack.

According to some embodiments, the robotic arm comprises six degrees of freedom.

According to some embodiments, the frame comprises a carriage mechanism.

According to some embodiments, the carriage system further comprises a rod lifter and a carriage configured to convey a drill rod.

According to some embodiments, the robotic arm comprises six degrees of freedom.

According to some embodiments, the method is configured to operate autonomously.

Other aspects and features will become apparent, to those ordinarily skilled in the art, upon review of the following description of some exemplary embodiments.

BRIEF DESCRIPTION OF THE DRAWINGS

The drawings included herewith are for illustrating various examples of articles, methods, and apparatuses of the present specification. In the drawings.

DETAILED DESCRIPTION

Various apparatuses or processes will be described below to provide an example of each claimed embodiment. No embodiment described below limits any claimed embodiment and any claimed embodiment may cover processes or apparatuses that differ from those described below. The claimed embodiments are not limited to apparatuses or processes having all of the features of any one apparatus or process described below or to features common to multiple or all of the apparatuses described below.

Further, although process steps, method steps, algorithms or the like may be described (in the disclosure and/or in the claims) in a sequential order, such processes, methods and algorithms may be configured to work in alternate orders. In other words, any sequence or order of steps that may be described does not necessarily indicate a requirement that the steps be performed in that order. The steps of processes described herein may be performed in any order that is practical. Further, some steps may be performed simultaneously.

When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article.

Described generally herein is a drill rod handling robotic system, and an associated method. The drill rod handling system comprises a removable drill rod magazine loaded with drill rods, a robotic arm, an end effector and a frame to which these components are mounted. The end effector may grab drill rods dispensed from the magazine, one at a time, and thread these drill rods to drill rods in use in a drilling rig, to enable deeper drilling, without requiring manual handling. The removable magazines allow for large depths to be drilled with little manual intervention, and by coupling the magazine and robotic arm to fixed positions on a compact frame, the robotic drill rod handling system described herein may be effectively used in compact spaces, such as those that may be found in underground mining operations.

Figure 1:
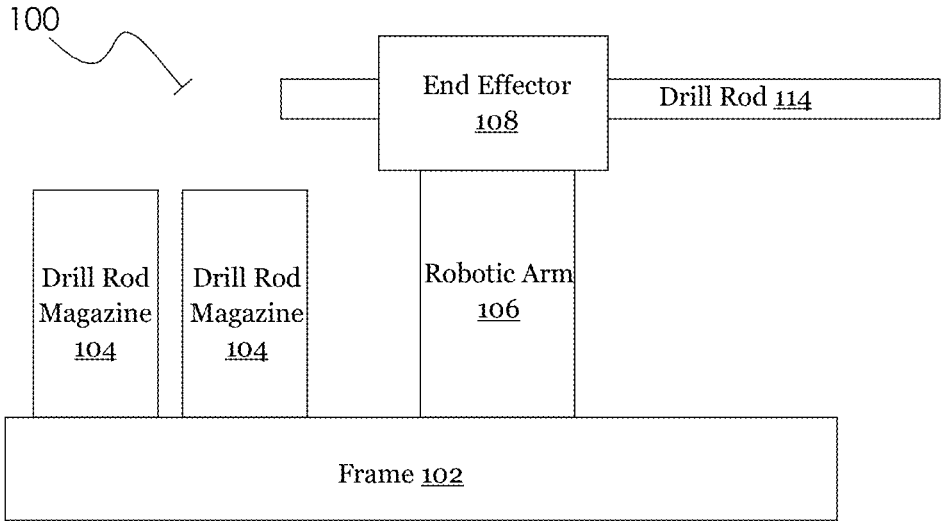
FIG. 1 is a block diagram of a drill rod handling system, according to an embodiment.

Referring first to FIG. 1, pictured therein is a system block diagram of a drill rod handling robotic system 100, according to an embodiment. System 100 comprises frame 102, drill rod magazine 104, robotic arm 106, end effector 108, and drill rod 114.

Frame 102 comprises a structural base to which the other components of system 100 are coupled. Frame 102 is constructed from a material that provides frame 102 with suitable structural rigidity.

Drill rod magazine 104 comprises a structure coupled to frame 102 for storing and feeding drill rods to a grasping position of system 100 wherein they may be grasped by end effector 106. Drill rod magazine comprises a removable magazine, wherein the magazines 104 may be removed if empty, and replaced with a full magazine, or vice versa, as required.

Robotic arm 106, comprises a multi-degree of freedom robotic arm, suitable for lifting and manipulating a drill rod in 3D space.

End effector 108 is coupled to the end of robotic arm 106, and is configured to grasp a drill rod such that it may be manipulated in position by robotic arm. End effector 108 is further configured such that end effector 108 may rotate a grasped drill rod about its longitudinal axis in both directions, and apply a translational force to a grasped drill rod along the longitudinal axis of the drill rod.

Drill rod 114 is a hollow, threaded steel drill rod, having a first end with male threads and a second end with female threads. Drill rod 114 may vary in diameter from 44 mm to 114 mm with a length of 3 m and may be constructed of an alloyed steel. Drill rod 114 may be oriented in drill rod magazine 204 in a manner with all first end male threads on a first side of drill rod magazine 204 and all second end female threads on a second side of drill rod magazine 204.

Figure 2:
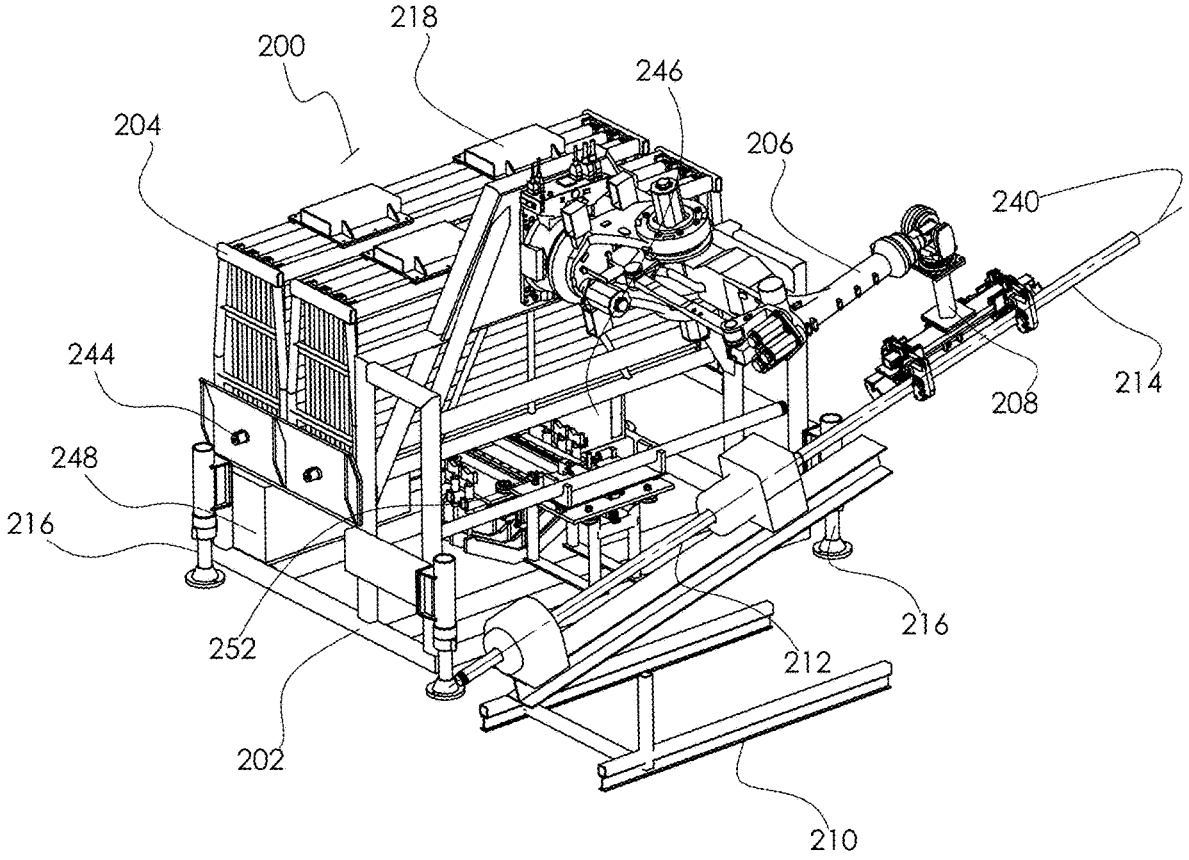
FIG. 2 is a perspective view of a drill rod handling system, according to another embodiment.

Referring now to FIG. 2, pictured therein is a perspective view of a drill rod handling robotic system 200, according to an embodiment. Components of system 200 may be analogous to system 100, with the reference characters of each component incremented by 100. System 200 comprises frame 202, drill rod magazine 204, robotic arm 206, end effector 208, and levelling jacks 216. System 200 is configured to work in conjunction with a drilling rig 210, pictured in FIG. 2.

Frame 202 comprises the overall mechanical structure of system 200 to which other components are coupled. Frame 202 is constructed from welded steel structural tubing, but in other embodiments, frame 202 may be constructed from other suitable materials and/or using other joining methods as required. Coupled to frame 202 are four leveling jacks 216 (three visible in FIG. 2). Leveling jacks 216 may each be individually adjusted in height such that system 200 may be used in environments with uneven ground surfaces.

Drill rod magazine 204 comprises a mechanical structure removably couplable to frame 202 for holding, storing and dispensing drill rods. Drill rod magazine 204 may comprise a structure constructed from welded steel structural tubing. A plurality of drill rods may be placed into drill rod magazine 204, arranged in multiple columns. Three columns are present in the example of FIG. 2, but in other embodiments, other numbers of columns may be present. In the example of FIG. 2, two magazines 204 are present, however, in other embodiments, fewer or more magazines 204 may be present.

Drill rod magazine 204 is configured such that drill rods are stored horizontally, axially parallel to the ground. This horizontal configuration allows for drill rods to be fed via gravitational force, eliminating the need for an additional drive mechanism to feed drill rods.

Drill rod magazine 204 further comprises forklift guides 218, such that the drill rod magazine 204 may be easily removed and manipulated away from the frame 202 using a forklift coupled to forklift guides 218.

Drill rod magazine 204 is coupled to frame 202 through coupling mechanism 244. Coupling mechanism 244 comprises corresponding mechanical features on frame 202 and magazine 204, allowing for drill rod magazine 204 to remain coupled to frame 202 through gravitational force. When magazine 204 is coupled to frame 202, it may be lifted directly off of frame 202, decoupling coupling mechanism 244. In some examples, coupling mechanism 244 comprises a shot pin style actuator positively securing drill rod magazine 204 to locating pads on frame 202. Proper alignment is achieved between drill rod magazine 204, rod lifter forks 234-1 and carriage 236 when coupling mechanism 244 is engaged. Drill rod magazine 204 can freely be lifted off frame 202 when coupling mechanism 244 is disengaged.

In operation, drill rod magazine 204 may be removed from frame 202, and loaded with empty drill rods. Drill rod magazine 204 may then be coupled to frame 202. Drill rods may be dispended from the bottom of drill rod magazine for further use and actuation by robotic arm 206 and end effector 208.

Robotic arm 206 comprises an industrial robotic arm capable of supporting the mass of a drill rod, for manipulating drill rods. Robotic arm 206 comprises an off the shelf industrial robotic arm with six degrees of freedom. Robotic arm 206 may manipulate end effector 208 which is coupled to robotic arm such that drill rods may be moved from a grasping position near the magazine 204, to the drilling rig 210, or vice versa.

End effector 208 is coupled to the end of robotic arm 206, and is configured to grasp and rotate drill rods about a first axis 240. End effector 208 is configured such that drill rods may be securely held in any rotational orientation. End effector 208 is shown in FIG. 2 grasping drill rod 214.

System 200 further includes robot controller 246, which includes electrical and control components for robotic arm 206, and electrical enclosure 248, which comprises electrical supply components required for the operation of system 200.

Drilling rig 210 comprises a mechanical structure for the use of drill rods. Drill rods may be loaded into drilling rig 210, which may then be applied to drilling into a surface. Additional drill rods may be coupled to drill rods loaded into drilling 210 to extend the possible drilling depth of drilling rig 210. Drilling rig 210 may be manually operated by an operator using a control panel, or may be integrated into the control system of system 200 for fully automatic operation.

Figure 3:
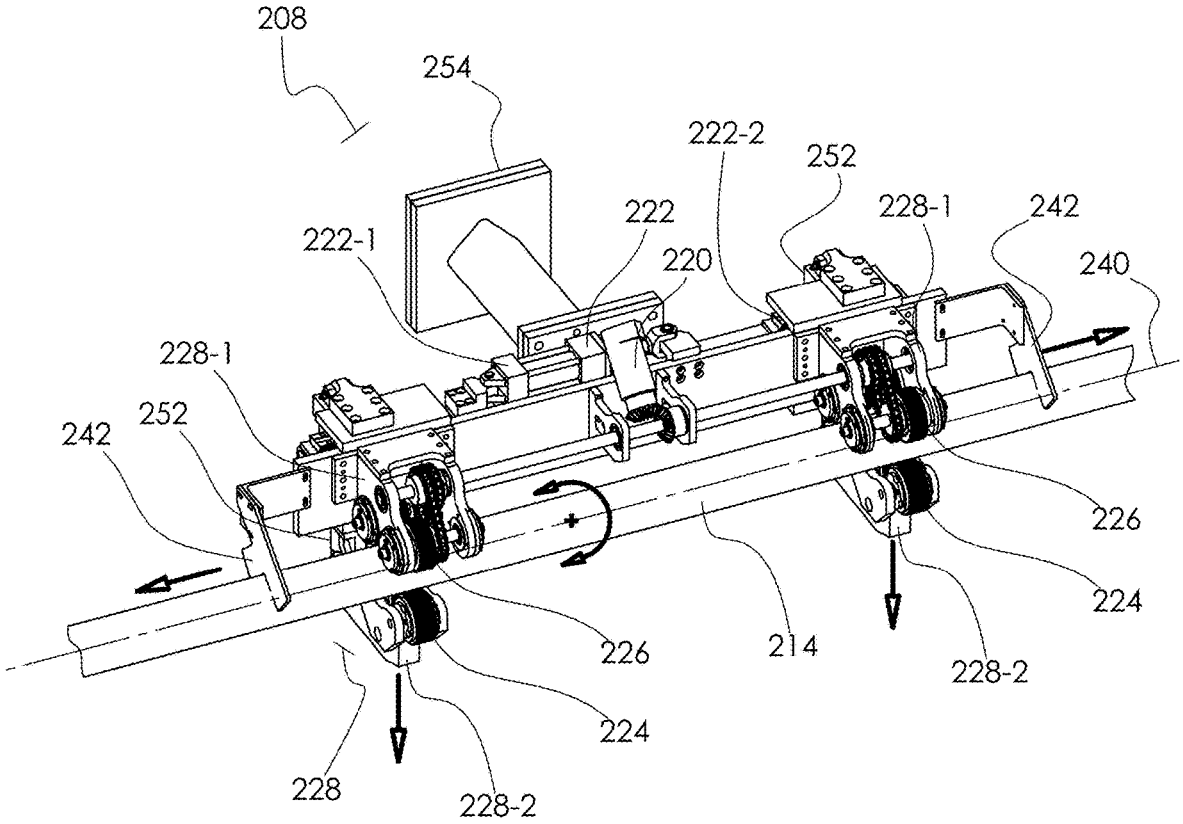
FIG. 3 is a perspective view of an end effector of the system of FIG. 2, according to an embodiment.

Referring now to FIG. 3, pictured therein is a perspective view of end effector 208 of system 200. End effector 208 comprises motor 220, thread compensation mechanism 222, idle rollers 224, jaws 228 and drive rollers 226. End effector 208 is shown grasping drill rod 214 in jaws 228.

Motor 220 comprises a hydraulic motor, capable of rotating a drill rod that is grasped by end effector 208. In other embodiments, motor 220 may comprise an electric or pneumatic motor.

Jaws 228 of end effector 208 comprise the general mechanical structure in which drill rods (e.g. rod 214) are grasped and secured. End effector 208 may be manipulated in position such that the jaws 228 surround a drill rod. End effector 208 comprises jaws 228 with two halves. Jaws 228 comprise lower jaws 228-2 and upper jaws 228-1. The jaws 228 may be actuated (by moving lower jaws 228-2), until the drill rod is securely held within the jaws 228 of end effector 208. The position wherein a drill rod may be securely held within the jaws 228 of the end effector may be referred to as the closed position of the end effector 208 and the position wherein the drill rod may be readily removed from the jaws 228 of the end effector 208 may be referred to as the open position of the end effector 208.

Lower jaws 228-2 are actuated through jaw actuation mechanisms 252, which each comprise a linear actuator. End effector 208 comprises two jaw actuation mechanisms, one for each jaw half.

Idle rollers 224 comprise smooth rollers which may contact and support the external surface of a drill rod. Idle rollers 224 are positioned on lower portions 228-2 of jaws 228 of end effector 208. The example of FIG. 3 comprises 4 idle rollers 224 at each half of jaw 228, for a total of 8 idle rollers 224. In other example, more idle rollers 224 or fewer idle rollers 224 may be present.

Drive rollers 226 comprise rollers which may mechanically engage the external surface of a drill rod. Drive rollers 226 are positioned on upper portions 228-1 of jaws 228, and mechanically coupled to motor 220, such that motor 220 may rotate drive rollers. In the example of FIG. 3, four drive rollers 226 are present, two at each half of jaw 228, however, in other examples, more or less drive rollers 226 may be present. In the example of FIG. 3, drive rollers 226 are coupled to motor 220 through a series of gears, shafts and chains, but any suitable mechanical connection may be used to couple motor 220 to drive rollers 226.

When jaws 228 are closed around drill rod 214, with end effector 208 in the closed position, drill rod 214 is clasped between drive rollers 226 and idle rollers 224. Jaws 228 may be closed by actuating the position of lower jaws 228-2 relative to upper jaws 228-1, using a linear motion mechanism. In other examples, upper jaws 228-1 may move while lower jaws 228-2 are stationary, or both upper jaws 228-1 and lower jaws 228-2 may move. Configurations wherein upper jaws 228-1 are fixed in position may advantageously provide for mechanical simplicity, as upper jaws 228-1 comprise the drive rollers 226 which must be coupled to motor 220.

End effector 208 additionally comprises two support structures 242, which provide additional stability when a drill rod is grasped by end effector 208.

Thread compensation mechanism 222 comprises a mechanism that allows for an additional translational degree of freedom through end effector 208. End effector 208 components may be translated along a direction parallel to the axial direction 240 of a drill rod 214 held by end effector 208, as depicted by the arrow of FIG. 3. Thread compensation 222 comprises a sliding bearing 222-2, and an actuator 222-1. The actuator 222-1 may comprise a pneumatic, hydraulic, or electric actuator. Thread compensation mechanism 222 allows for a first grasped drill rod to be translated in the axial direction, to apply a preload force between the first grasped drill rod and a second drill rod to which the first drill rod is to be coupled to. Thread compensation mechanism 222 allows for a preload to be applied to drill rods to thread drill rods together.

End effector 208 further comprises robotic arm attachment structure 254. End effector 208 attaches to robotic arm 206 through attachment structure 254.

Figure 4:
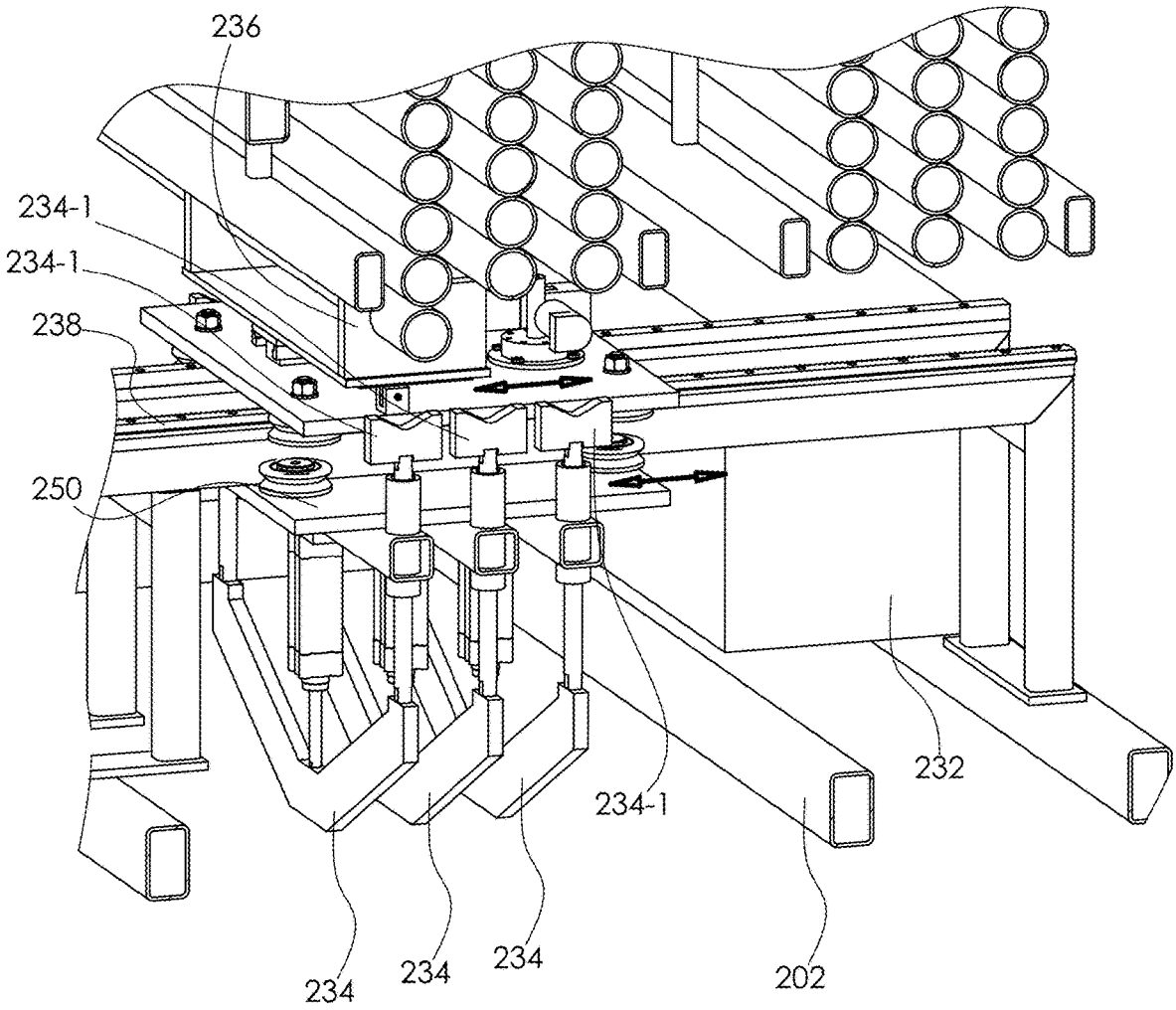
FIG. 4 is a detail perspective view of a carriage system of the system of FIG. 2, according to an embodiment.

Referring now to FIG. 4, pictured therein is a detail perspective view of drill rod carriage system 232. Carriage system 232 comprises a plurality of rod lifters 234, and a carriage 236. Carriage system 232 is coupled to frame 202, and interacts with drill rods inside magazines 204.

Rod lifters 234 comprise linear actuators for manipulating drill rods in magazine 204. Rod lifters 234 are each positioned under a column of drill rods in magazine 204. In the example herein, magazine 204 comprises four columns and, accordingly, four rod lifters 234, however, in other examples, more or fewer columns, and, accordingly, more or fewer rod lifters 234. Rod lifters 234 may each lift a column of drill rods, to manipulate the positions of drill rods.

Each rod lifter 234 includes two horizontally separated rod lifter forks 234-1, which directly cradle the drill rod at the bottom of the magazine. Both rod lifter forks 234-1 of each rod lifter are actuated in tandem.

Carriage 236 comprises a structure which may translate along rail 238. Carriage 236 may be driven hydraulically, electrically, or through other means as required.

Through cooperation with rod lifters 234, drill rods may be placed onto carriage 236, and translated away from magazine 204, placing a drill rod in a grasping position (as shown in FIG. 4), for manipulation by the end effector 208 and robotic arm 206. For example, empty carriage 236 may be moved under a column of drill rods, and the column of drill rods may be lowered with rod lifter 234 until a drill rod is placed onto carriage 236. The rod lifter 234 may then be raised to provide carriage 236 with clearance to translate along rail 238, to place the drill rod into the grasping position, as shown in FIG. 4.

Carriage system 232 comprises a mechanism to cingulate a drill rod from the column of drill rods, as seen in FIG. 4. This action provides clearance for rod lifters 234 to lift the column of drill rods. The carriage 236 must support the full weight of the drill rod column while a drill rod is being cingulated.

Referring again to FIG. 2, in operation, system 200 may be provided with no drill rod present in jaws 228 of end effector 208, and with at least one drill rod in magazine 204. The drill rod in magazine 204 may be conveyed to the grasping position of system 200 by carriage system 232 as described above. Once the drill rod is in the grasping position, the end effector 208 may be manipulated such that jaws 228 surround the drill rod. If the end effector 208 is in the closed position, it may be actuated such that it is moved into the open position before it is positioned to surround the drill rod. Once surrounding the drill rod, end effector 208 may be placed into the closed position, such that the drill rod is securely grasped by jaws 228.

Once the drill rod is grasped by the jaws 228, the robotic arm 206 may be manipulated in position until the drill rod 214 grasped by jaws is axially aligned with a second drill rod 212 positioned in drilling rig 210, as shown in FIG. 2. In this configuration, male type threads of the first end of drill rod 214 and female type threads of the second end of drill rod are aligned axially.

After this axial alignment of drill rods, thread compensation mechanism 222 may then be actuated to apply a preload force between rod 212 and rod 214.

After the application of the preload force, drill rod 214 will be rotated to couple drill rod 214 to drill rod 212. In some examples, the rotational range required to fully secure one drill rod to another may be preset, and system 200 may be configured to rotate through this preset range. In other examples, end effector 208 may further comprise a transducer which may detect when one drill rod has been secured to the other drill rod, and provide feedback to cease rotation when such a condition is detected.

Once the drill rods 212, 214 are secured to one another, end effector 208 may be moved into the open position, and the robotic arm 206 may actuate the end effector away from drilling rig 210. In some examples, the robotic arm 206 may actuate end effector 208 back to the grasping position, wherein the end effector may grasp another drill rod which has been placed into the grasping position by carriage system 232, for coupling to drill rod 214. In the meantime, drilling rig 210 may be operated to drill rod 214 deeper into the drilling target.

This operation may be repeated any number of times as required to reach the drilling depths desired for a specific drilling operation. In some examples, magazine 204 may be emptied of drilling rods through the repeated use and consumption of drill rods. In such examples, magazines 204 may be removed (e.g. with a forklift), and replaced with a full magazine 204, allowing for drilling to even deeper depths.

In some examples, the operation described above may be performed in reverse to remove drill rods from drilling rig 210, and place them back onto an empty magazine 204. This operation may be repeated until all drill rods are removed from drilling rig 210. In such examples, magazines 204 may be periodically replaced when full, to allow for retrieving the drill rods of large drilling depths.

The configuration of system 200 provides for a number of advantages over other robotic drill rod handling solutions. The use of a removable drill rod magazine allows for large depths to be drilled, wherein empty magazines are replaced with full magazines as necessary. The use of a gravity fed magazine simplifies the design of the magazine and reduces cost and complexity. Coupling drill rod storage in magazines to the robotic arm via a frame enables easy setup of the system, as no calibration is required to orient the robotic arm to the storage source of the drill rods. By providing a thread compensation mechanism, cross threading of drill rods is unlikely, increasing system reliability. The combination of a vertical magazine, a compact frame, and a high degree of freedom robotic arm allows for a compact overall system, enabling the use of the system in compact spaces such as those found in underground mining operations or other spaces.

Additionally, system 200 protects operators from hazards, and increases the speed of deployment, and removal of a drilling system utilizing drill rods.

System 200 may further comprise control and power supply components, such as electrical supply units, hydraulic pumps, microcontrollers, PLCs, or other power and/or control equipment. Such equipment may be coupled to robotic arm 206, end effector 208, carriage system 232, or other components of system 200, for the control and operation of system 200.

The operation of system 200 may be conducted manually (e.g. wherein the robotic arm is actuated by a skilled operator using a control interface), or autonomously, wherein the robotic arm has been preprogrammed to traverse a path between the drilling rig and drill rod grasping position. In some examples wherein autonomous operation is employed, system 200 may be pre-calibrated, to determine the robotic path required to actuate the robotic arm 206 between the drilling rig and grasping position.

Figure 5:
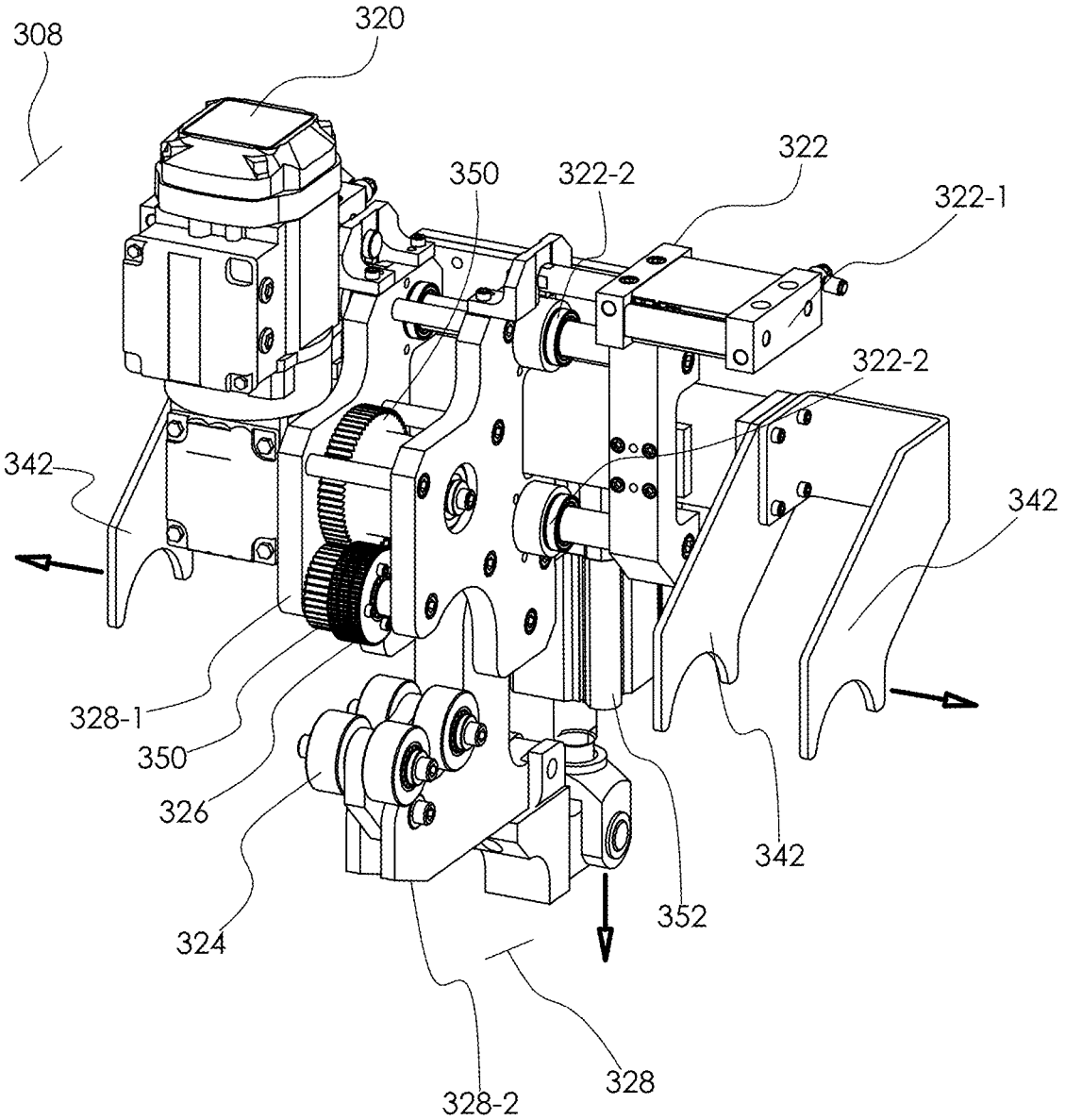
FIG. 5 is a detail perspective view of an end effector of the system of FIG. 2, according to another embodiment.

Referring now to FIG. 5, pictured therein is a perspective view of end effector 308. End effector 308 comprises motor 320, thread compensation mechanism 322, idle rollers 324, and drive rollers 326.

End effector 308 is a variant of end effector 208 comprising a single jaw and utilizing an electric motor 320 instead of the hydraulic motor of end effector 208. The operation of end effector 308 is identical to that of end effector 208, other than the variation of motor (electric versus hydraulic), and the single jaw configuration.

End effector 308 advantageously does not require a hydraulic source for its motor, and is mechanically more compact, due to its single jaw configuration, versus the two half configuration of end effector 208. Additionally, end effector 308 differs in that it comprises three support structures 342 versus the two support structures 242 of end effector 208. Such a configuration may be advantageous in use cases wherein hydraulic sources are not available, or where end effector 208 is too large for efficient operation (e.g. in enclosed spaces).

As shown in FIG. 5, lower jaw member 328-2 may be actuated upwards and downwards with jaw actuation mechanism 352, which comprises a linear actuator.

Motor 320 is coupled to drive rollers 326 through two transfer gears 350.

Thread compensation mechanism 322 comprises sliding bearings 322-2 and linear actuator 322-1. By applying force using linear actuator 322-1, components of end effector may be linearly translated, as depicted by the arrows of FIG. 5.

Figure 6:
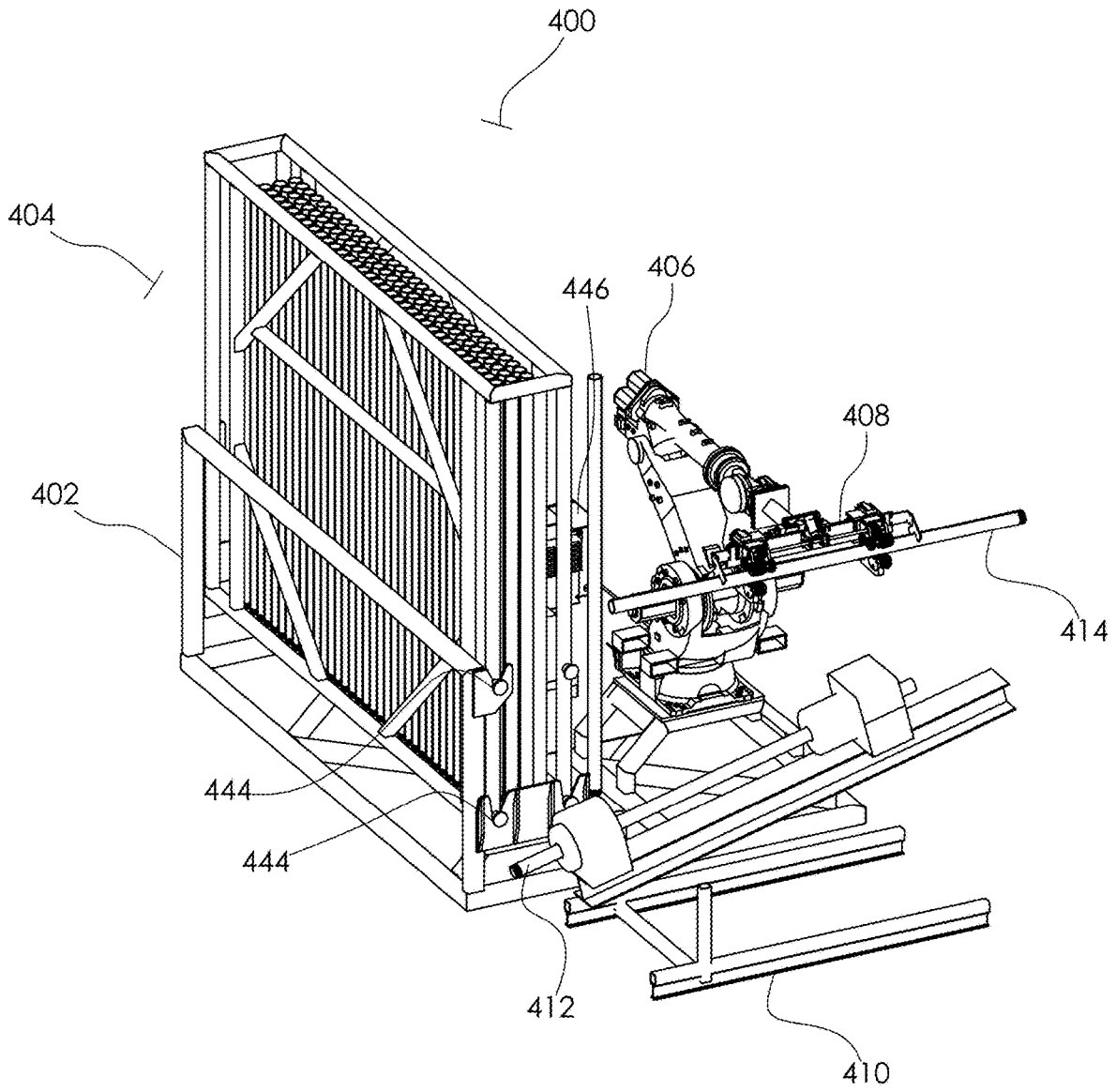
FIG. 6 is a perspective view of a drill rod handling system having a vertically oriented drill rod magazine, according to another embodiment.

Referring now to FIG. 6, pictured therein is a variant of the system of FIGS. 2-4, drill rod handling system 400. System 400 is analogous to system 200, but differs in that drill rods in magazine 404 are arranged in a vertical orientation, with the axial direction of each drill rod generally perpendicular to the ground surface, versus the horizontal arrangement of magazine 204. Drill rod magazine 404 is generally similar to magazine 204 otherwise, and functions in a similar manner.

System 400 further comprises frame 402, robotic arm 406, end effector 408, attachment mechanism 444, and robot controller 446 and interacts with nearby drilling rig 410. Components of system 400 (other than magazine 404) are analogous to components of system 200, with reference characters incremented by 200. Description above in reference to system 200 similarly applies to system 400.

Robotic arm 406 may be actuated such that end effector 408 may grasp a second drill rod 414 from a grasping position. After, robotic arm 406 may be actuated to align drill rod 414 axially with drill rod 412, which is coupled to drilling rig 410. Once axially aligned, a thread compensation mechanism of end effector 408 may be used to apply a preload force between the threads of drill rod 412 and 414. After the preload force is applied, drill rod 414 may be rotated to couple drill rod 414 to drill rod 412. Once drill rods 412, 414 are coupled, end effector 408 may be moved to the open position to separate end effector 408 from drill rod 414. The robotic arm 406 may now to manipulated to grasp another drill rod to repeat the process above.

Figure 7:
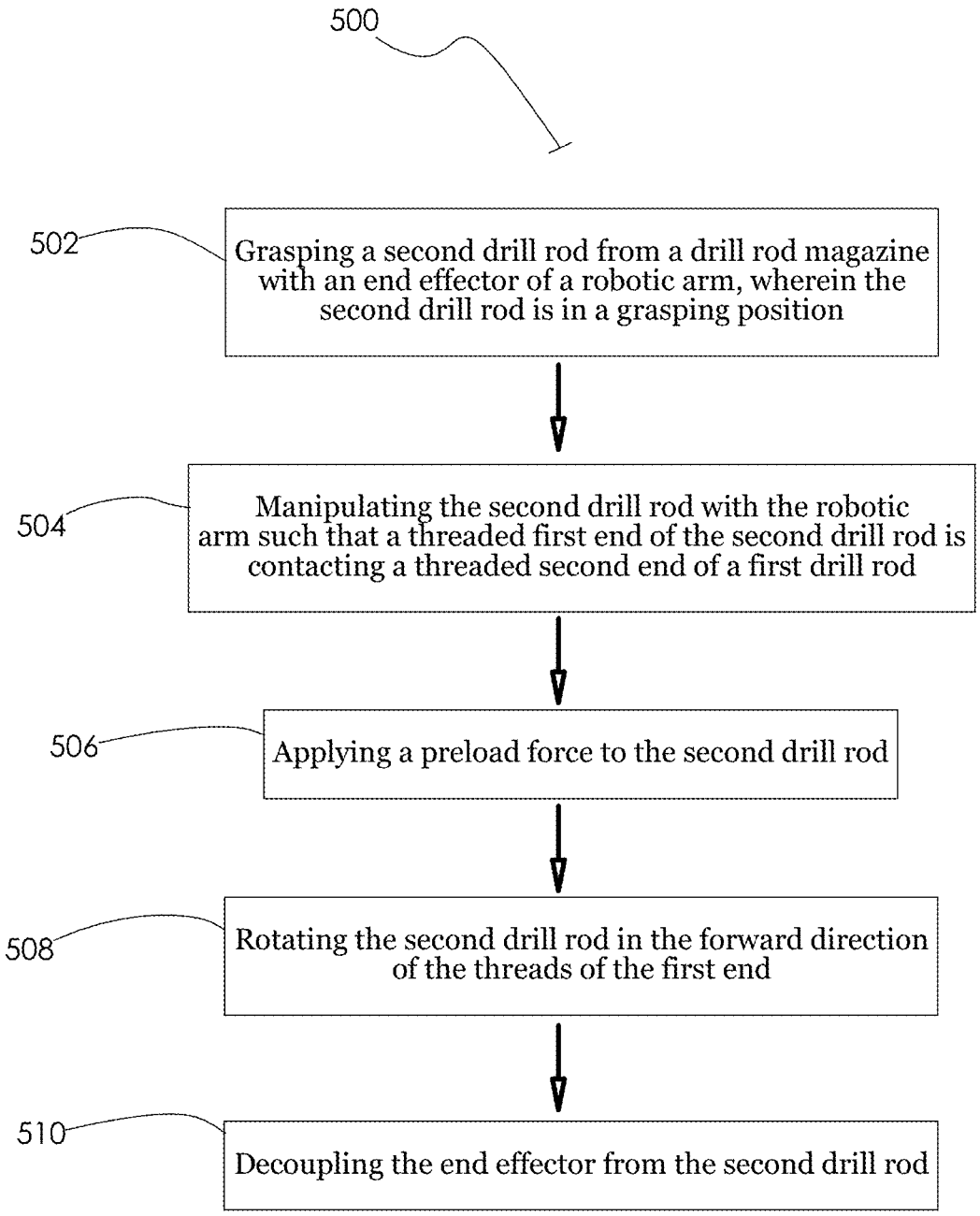
FIG. 7 is a flow chart depicting a method of using the systems of FIGS. 1-6 according to another embodiment.

Referring now to FIG. 7, pictured therein is a flow chart describing a method 500 of robotic drill rod handling. Method 500 comprises 502, 504, 506, 508, and 510. Method 500 may be conducted using the systems described above in reference to FIGS. 1-6 above. Description in reference to FIGS. 1-6 above may similarly apply to method 500 described herein.

At 502, a second drill rod from a drill rod magazine is grasped with an end effector of a robotic arm, wherein the second drill rod is in a grasping position.

At 504, the second drill rod is manipulated with the robotic arm such that a threaded first end of the second drill rod is contacting a threaded second end of a first drill rod.

At 506, a preload force is applied to the second drill rod.

At 508, the second drill rod is rotated in the forward direction of the threads of the first end, coupling the first drill rod and second drill rod.

At 510, the end effector is decoupled from the second drill rod.

While the above description provides examples of one or more apparatus, methods, or systems, it will be appreciated that other apparatus, methods, or systems may be within the scope of the claims as interpreted by one of skill in the art.

The invention claimed is:

1. A drill rod handling robotic system, the system comprising:

a frame;

a robotic arm for manipulating drill rods, the robotic arm coupled to the frame; and a drill rod end effector, for grasping drill rods, the end effector coupled to the robotic arm, wherein the end effector comprises a first jaw and a second jaw for grasping a drill rod, and a single thread compensation mechanism positioned between and coupled to the first jaw and the second jaw, wherein the single thread compensation mechanism is configured for translating the grasped drill rod along a first axis by concurrently translating each of the first jaw and the second jaw along a direction parallel to the first axis, wherein the single thread compensation mechanism is configured to apply a preload force between drill rods to thread drill rods together;

wherein the system is configured to:

manipulate the robotic arm such that the end effector surrounds a second drill rod in a grasping position of the system;

grasp the second drill rod with the end effector;

manipulate the second drill rod to align the second drill rod with a first drill rod which is coupled to a drilling rig; and rotate the second drill rod to couple the second drill rod to the first drill rod.

2. The system of claim 1, wherein the end effector is configured to grasp and rotate drill rods about a first axis.

3. The system of claim 1, wherein the thread compensation mechanism comprises a sliding bearing, and an actuator.

4. The system of claim 1, further comprising a drill rod magazine for storing and dispensing drill rods, the magazine removably coupled to the frame, wherein the drill rod magazine is a gravity fed magazine, with the drill rods arranged in the magazine horizontally relative to the ground.

5. The system of claim 1, wherein the system further comprises a carriage system coupled to the frame.

6. The system of claim 5, wherein the carriage system further comprises a rod lifter and a carriage configured to convey a drill rod.

7. The system of claim 1, wherein the system is further configured to:

grasp the second drill rod coupled to a first drill rod with the end effector, wherein the first drill rod is coupled to the drilling rig;

rotate the grasped second drill rod to decouple the second drill rod from the first drill rod;

manipulate the second drill rod using the robotic arm to place the second drill rod in the grasping position; and decouple the end effector from the second drill rod.

8. The system of claim 1, wherein the frame is leveled to a ground surface.

9. The system of claim 1, wherein the robotic arm comprises six degrees of freedom.

10. The system of claim 1, wherein the system is configured to operate autonomously.

11. A method of robotic drill rod handling, the method comprising:

grasping a second drill rod from a grasping position of a frame of a drill rod handling system with an end effector of a robotic arm, wherein the second drill rod is in a grasping position, wherein the end effector comprises a first jaw and a second jaw for grasping a drill rod, and a single thread compensation mechanism positioned between and coupled to the first jaw and the second jaw, wherein the single thread compensation mechanism is configured for translating the grasped drill rod along a first axis by concurrently translating each of the first jaw and the second jaw along a direction parallel to the first axis, wherein the single thread compensation mechanism is configured to apply a preload force between drill rods to thread drill rods together;

manipulating the second drill rod with the robotic arm such that a threaded first end of the second drill rod is contacting a threaded second end of a first drill rod;

applying the preload force to the second drill rod;

rotating the second drill rod in the forward direction of the threads of the first end, coupling the first drill rod and second drill rod; and decoupling the end effector from the second drill rod.

12. The method of claim 11, wherein the first drill rod is coupled to a drilling rig.

13. The method of claim 11, wherein the drill rod handling system comprises a removable drill rod magazine.

14. The method of claim 13, wherein the drill rod magazine is a gravity fed magazine, with the drill rods arranged in the magazine horizontally relative to the ground.

15. The method of claim 11, wherein the frame comprises a leveling jack.

16. The method of claim 11, wherein the robotic arm comprises six degrees of freedom.

17. The method of claim 11, wherein the frame comprises a carriage mechanism.

18. The method of claim 17, wherein the carriage system further comprises a rod lifter and a carriage configured to convey a drill rod.

19. The method of claim 17, wherein the robotic arm comprises six degrees of freedom.

20. The method of claim 11, wherein the method is configured to operate autonomously.

* * * * *